United States Patent [19]

Arbib

[11] 4,117,532

[45] Sep. 26, 1978

[54] LAMP SHADE CONSTRUCTION AND METHOD

[75] Inventor: Richard Arbib, New York, N.Y.

[73] Assignee: Richard Arbib Company, Inc., New York, N.Y.

[21] Appl. No.: 749,660

[22] Filed: Dec. 10, 1976

[51] Int. Cl.[2] ..... F21V 1/04

[52] U.S. Cl. ..... 362/358; 362/356; 362/806

[58] Field of Search ..... 240/108 R, 108 B, 109

[56] References Cited

U.S. PATENT DOCUMENTS

| | | | |
|---|---|---|---|
| 1,002,216 | 9/1911 | Branch | 240/109 |
| 1,310,347 | 7/1919 | Karfiol | 240/109 |
| 2,659,809 | 11/1953 | Melia | 240/108 R X |

*Primary Examiner*—Richard L. Moses

*Attorney, Agent, or Firm*—Blum, Moscovitz, Friedman & Kaplan

[57] ABSTRACT

A one-piece lamp shade construction that is capable of being manufactured in a wide variety of styles. The lamp shade has a circumferential framework of wire mesh or perforated sheet stock and a layer of plastic forming the body of the shade. The plastic is molded from the inside of the pre-formed framework and extends through the openings in the framework thereby joining the framework to the plastic body. The invention is concerned with the lamp shade construction and method.

8 Claims, 7 Drawing Figures

FIG. 4
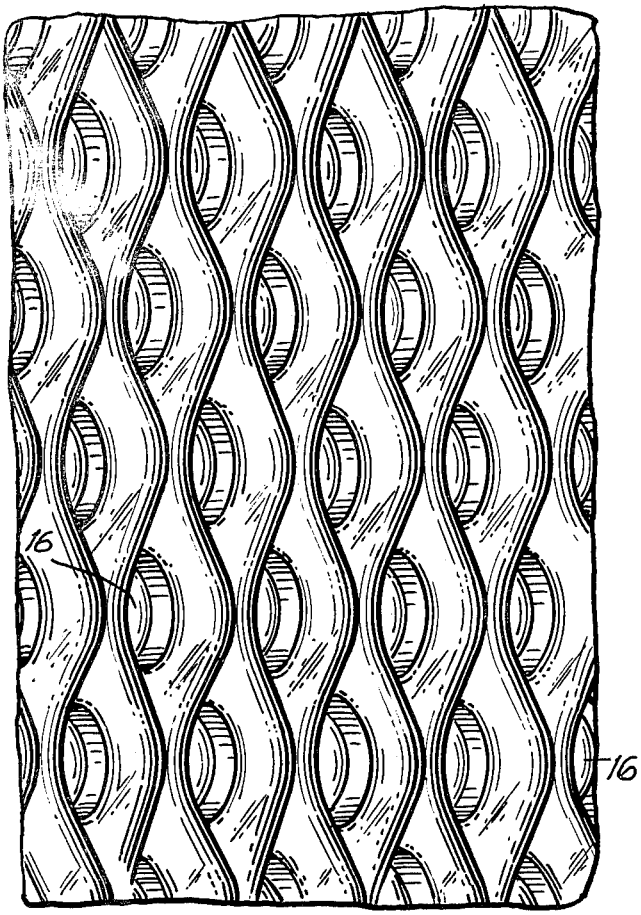
FIG. 6
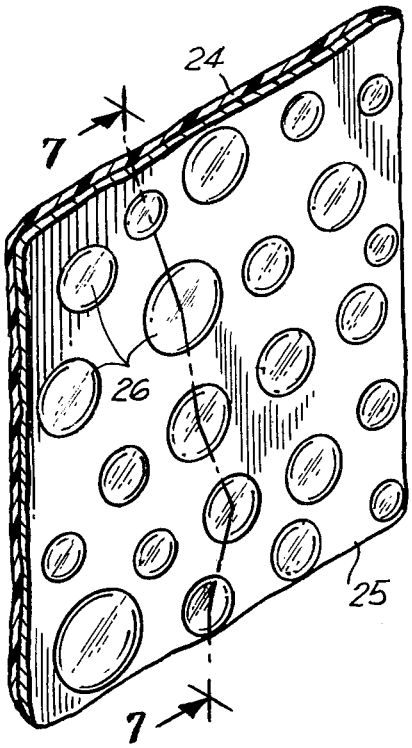
FIG. 5
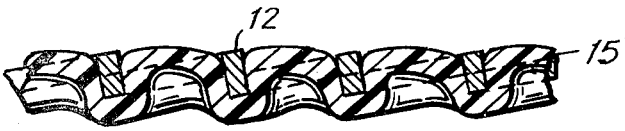
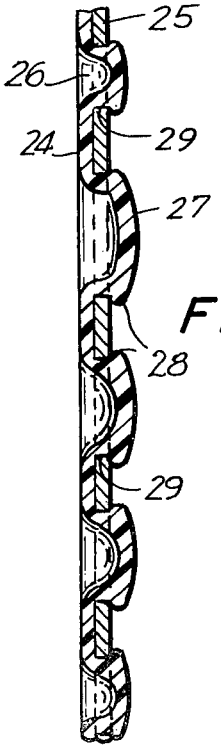
FIG. 7

LAMP SHADE CONSTRUCTION AND METHOD

BACKGROUND OF THE INVENTION

This invention relates generally to a lamp shade construction and method of forming same. While other lamp shade constructions are known in the art, such constructions have been less than completely satisfactory. In order for such constructions to maintain sufficient rigidity, such constructions have required the use of steel rings located at the upper and lower edge of the lamp shade. Additionally, such constructions have required a considerable amount of hand labor. Furthermore, such constructions have been fairly limited in the scope of styling which they provided.

SUMMARY OF THE INVENTION

Generally speaking, in accordance with the invention, a one-piece lamp shade construction and method is provided. The construction has a circumferential framework. The framework has a series of openings and may be either a mesh or a perforated sheet such as a metal band or a plurality of bands. The body of the lamp shade is preferably fabricated of thermoplastic material which is preferably blow-molded from within or interiorly of the circumferential framework. The thermoplastic material extrudes through the openings in the framework and seals the openings thereby bonding the body and framework as a single unit. A variety of sizes and styles may be manufactured by the use of different frameworks and molds. Also, a wide variety of interesting and attractive shades may be produced.

Accordingly, it is an object of this invention to provide an improved lamp shade construction which eliminates the need for upper and lower frame support rings, and therefore may be manufactured in one piece.

Another object of this invention is to provide an improved lamp shade construction that requires little hand labor to manufacture.

A further object of this invention is to provide an improved lamp shade construction which permits of a wide variety of styles, shapes, colors, textures and decorative effects.

Yet another object of this invention is to provide an improved lamp shade construction that is strong and durable, which will not easily crush or tear and which is completely washable.

A further object of the invention is to provide an improved method of fabricating a lamp shade.

Still other objects and advantages of the invention will in part be obvious and will in part be apparent from the specification.

The invention acordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is an enlarged partial internal elevational view of the side wall of the embodiment of FIG. 1;

FIG. 5 is a partial sectional view taken along line 5—5 of FIG. 3;

FIG. 6 is an enlarged partial perspective view of a further embodiment of the present invention utilizing a perforated metal framework; and FIG. 7 is a partial sectional view taken along line 7—7 of FIG. 6.

DESCRIPTION OF THE PREFERRED EMBODIMENTS

Figure 1:
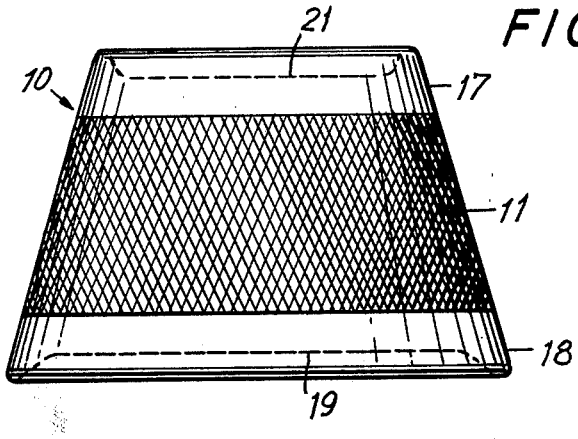
FIG. 1 is a side elevational view of a lamp shade constructed in accordance with a first embodiment of the present invention.
Figure 3:
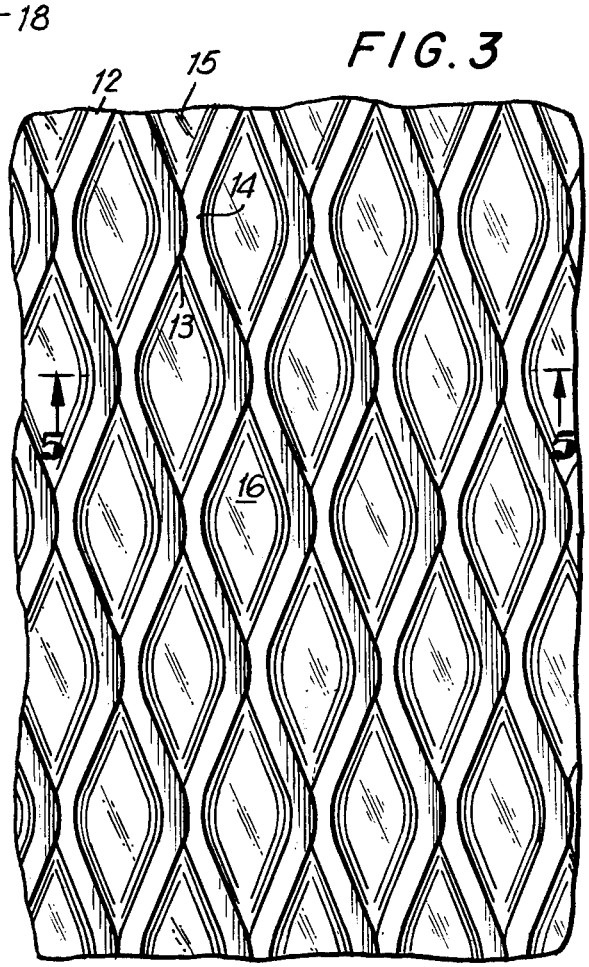
FIG. 3 is an enlarged partial external elevational view of the side wall of the embodiment of FIG. 1.

Referring now to FIGS. 1, 3 and 4, a lamp shade 10 has an expanded metal mesh circumferential framework 11 in the form of a truncated cone. The stock 12 used to construct framework 11 is rectangular in cross section with a diamond shape mesh pattern. An edge 13 of each diamond overlaps an edge 14 of the adjacent diamond pattern when viewed in plan to form a three dimensional mesh. This type of mesh pattern provides a secure bond of the plastic layer 15 to framework 11 due to the plastic 15 overlaying edge 14 of stock 12 when the plastic is extruded through the mesh openings. While a metal mesh framework 11 is preferred, any composition that will not deteriorate during the forming of the plastic layer 15 may be used.

As shown in FIG. 1, framework 11 is first formed into the desired conical shape, framework 11 may then be spot-welded in order to maintain its form. After the initial shaping, framework 11 is then ready for the application of layer 15, preferably by a blow-molding process. Framework 11 is placed in a mold and a layer of thermoplastic 15 is blow-molded to form the body. Layer 15 completely coats the inner surface of framework 11 and generally conforms to the shape of framework 11 as shown in FIG. 4. The molding process forces layer 15 through each cell 16 of the mesh framework 11. Layer 15 forms a coating over each cell 16 which seals each cell and joins layer 15 to framework 11. By controlling the distance from the wall of the mold to framework 11, when the framework is first mounted in the mold, plastic layer 15 can be made to "bubble" or "pillow" out beyond framework 11 in a very attractive manner. When clear thermoplastic is used the effect is like individual panes of bottle glass.

By utilizing one or more framework members of selected sizes and colors and at selected locations in cooperation with clear or colored transparent, translucent or opaque layers, an unlimited array of attractive, as well as functional, lamp shades may be created.

The preferred molding process is the blow-molding process. However, other molding processes, such as vacuum forming, may be used. Polyethylene is preferred for layer 15, but other moldable or formable materials may be used.

The mold may be constructed and arranged so that framework 11 covers only a certain portion of the entire mold. Thus, as shown in FIG. 1, when framework 11 only covers a portion of the mold, layer 15 will extend beyond the mesh and surfaces, such as 17 and 18, free of framework 11 will be exposed at the surface of the lamp shade. A variety of decorative forms and designs, such as scalloping, may also be molded into the lamp during the molding process. Additionally, the mold may be used to form an upturned rim 19 and a downturned rim 21 on the lower and upper edges of shade 10 respectively, and, if the body is formed by blow-molding, it may be necessary to cut away central portions of upper and lower surfaces to complete the lamp shade.

Figure 2:
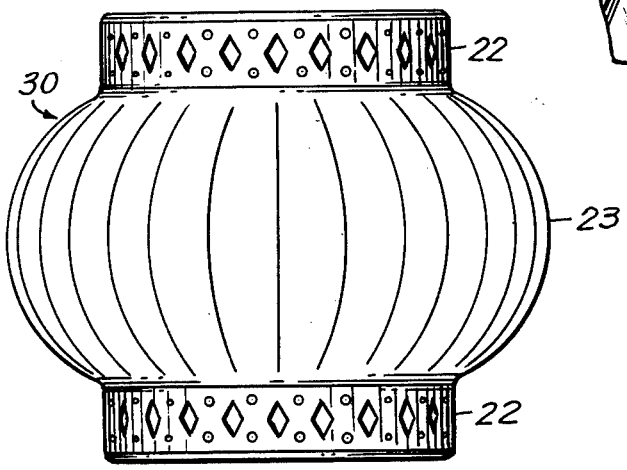
FIG. 2 is a side elevational view of a lamp shade constructed in accordance with a second embodiment of the present invention.

FIG. 2 illustrates another embodiment of the present invention. In this embodiment, the framework consists of upper and lower perforated metal bands 22. The center section 23 is blow-molded and contains no framework. The mold may be arranged so that various shapes or sculptured reliefs may be molded into the lamp shade 30. A wire mesh may also be used as the framework in place of perforated metal bands 22.

FIGS. 6 and 7 illustrate the bonding of plastic 24 to a framework of perforated metal 25. Perforated metal 25 has a series of openings 26 cut in a "Swiss cheese" pattern. When plastic 24 is blow-molded, it forms bubbles 27 extending beyond each opening 26 in perforated metal framework 25. The edge 28 of bubble 27 overlaps the edge 29 of each opening 26. When plastic 24 hardens or sets, the overlapping edge 28 of bubble 27 securely bonds plastic 24 to perforated metal framework 27.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A lampshade construction comprising at least one circumferential framework having an inner surface, an outer surface and a plurality of openings extending therethrough, and a layer of material covering said inner surface of said framework and having portions extending into said openings to seal said material to said framework, at least a portion of the outer surface of said framework being free from covering by said material.

2. A lamp shade construction as claimed in claim 1, wherein said framework comprises wire mesh.

3. A lamp shade construction as claimed in claim 1, wherein said framework comprises perforated metal.

4. A lamp shade construction as claimed in claim 1, wherein said portions extending into said openings extend through said openings and beyond said outer surface.

5. A lamp shade construction as claimed in claim 4, wherein said portions extending beyond said outer surface have cross-section dimensions which are greater than the cross-sectional dimensions of the respective openings through which they extend.

6. A lamp shade construction as claimed in claim 1, wherein said layer is comprised of a plastic material.

7. A method of forming a lampshade comprising the steps of forming a sheet of apertured material into a generally circular endless band having exterior and interior surfaces, molding a generally cylindrical body of plastic material, applying at least a portion of said body to the interior surface of said endless band, and applying a force to said plastic material to cause portions thereof to enter apertures in said endless band to seal said material to said endless band, at least a portion of said exterior surface of said endless band being free from covering by said material.

8. A method of forming a lamp shade as claimed in claim 7, wherein said force applied to said plastic material is sufficient to cause said portions entering apertures in said endless band to extend beyond said exterior surface.

* * * * *